US010120320B2

(12) United States Patent
Yamabe

(10) Patent No.: US 10,120,320 B2
(45) Date of Patent: Nov. 6, 2018

(54) SHEET TRANSPORT DEVICE AND IMAGE FORMING APPARATUS

(71) Applicant: CANON KABUSHIKI KAISHA, Tokyo (JP)

(72) Inventor: Daisuke Yamabe, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/208,207

(22) Filed: Jul. 12, 2016

(65) Prior Publication Data

US 2017/0017187 A1 Jan. 19, 2017

(30) Foreign Application Priority Data

Jul. 14, 2015 (JP) ..... 2015-140583

(51) Int. Cl.

| | |
|---|---|
| ***B65H 7/02*** | (2006.01) |
| ***G03G 15/00*** | (2006.01) |
| ***B65H 7/14*** | (2006.01) |
| ***B65H 5/06*** | (2006.01) |

(52) U.S. Cl.

CPC ..... *G03G 15/6567* (2013.01); *B65H 5/062* (2013.01); *B65H 7/14* (2013.01); *G03G 15/6511* (2013.01); *B65H 2403/20* (2013.01); *B65H 2553/612* (2013.01); *G03G 2215/00409* (2013.01)

(58) Field of Classification Search

CPC ..... B65H 2553/612; B65H 2403/20

See application file for complete search history.

(56) References Cited

U.S. PATENT DOCUMENTS

| | | | | |
|---|---|---|---|---|
| 4,061,328 | A * | 12/1977 | Fujimoto | B65H 1/04 271/10.1 |
| 7,941,063 | B2 * | 5/2011 | Suzuki | G03G 15/657 399/43 |
| 2010/0127451 | A1 * | 5/2010 | Rozenfeld | B43M 3/045 271/256 |
| 2012/0161384 | A1 * | 6/2012 | Suzuki | B65H 3/128 271/11 |
| 2012/0193863 | A1 * | 8/2012 | Harada | B65H 3/0684 271/110 |

FOREIGN PATENT DOCUMENTS

JP 2010083644 A 4/2010

* cited by examiner

*Primary Examiner* — Howard J Sanders

(74) *Attorney, Agent, or Firm* — Canon U.S.A., Inc. IP Division

(57) ABSTRACT

A sheet transport device includes a transport unit that transports a sheet, an endless belt that transmits a driving force from a motor to the transport unit, a rotary member that rotates by being pressed by the sheet transported by the transport unit, and a sensor that generates a signal in accordance with rotation of the rotary member. The rotary member is arranged in such a manner that a portion of the rotary member faces an inner peripheral portion of the endless belt.

12 Claims, 5 Drawing Sheets

SHEET TRANSPORT DEVICE AND IMAGE FORMING APPARATUS

BACKGROUND OF THE INVENTION

Field of the Invention

The present invention relates to a sheet transport device and an image forming apparatus that includes the sheet transport device.

Description of the Related Art

A sensing unit that detects a sheet is disposed on a transport path of a sheet transport device that is included in an image forming apparatus (see Japanese Patent Laid-Open No. 2010-83644). As an example, such a sensing unit includes a rotary member that rotates by being pressed by a sheet, which is transported, and a photo-interrupter that generates a signal according to the position of the rotary member.

There has been a growing demand for a reduction in the size of sheet transport devices. Sheet transport devices of the related art have not been able to sufficiently meet the recent demand for size reduction.

SUMMARY OF THE INVENTION

The present invention is directed at reducing the size of a sheet transport device.

A sheet transport device includes a transport unit that transports a sheet, an endless belt that transmits a driving force from a motor to the transport unit, a rotary member that rotates by being pressed by the sheet transported by the transport unit, and a sensor that generates a signal in accordance with rotation of the rotary member. The rotary member is arranged in such a manner that a portion of the rotary member faces an inner peripheral portion of the endless belt.

Further features of the present invention will become apparent from the following description of exemplary embodiments with reference to the attached drawings.

DESCRIPTION OF THE EMBODIMENTS

An embodiment of the present invention will be described below with reference to the drawings. However, the present invention is not limited to the following embodiment.

Note that, in the following description, which refers to the drawings, descriptions of components that are not necessarily illustrated are suitably omitted for ease of understanding of the following description. In addition, the directions, which are "upward, downward, rightward, leftward, frontward, and backward" directions indicated by arrows are common throughout the drawings.

Figure 1:
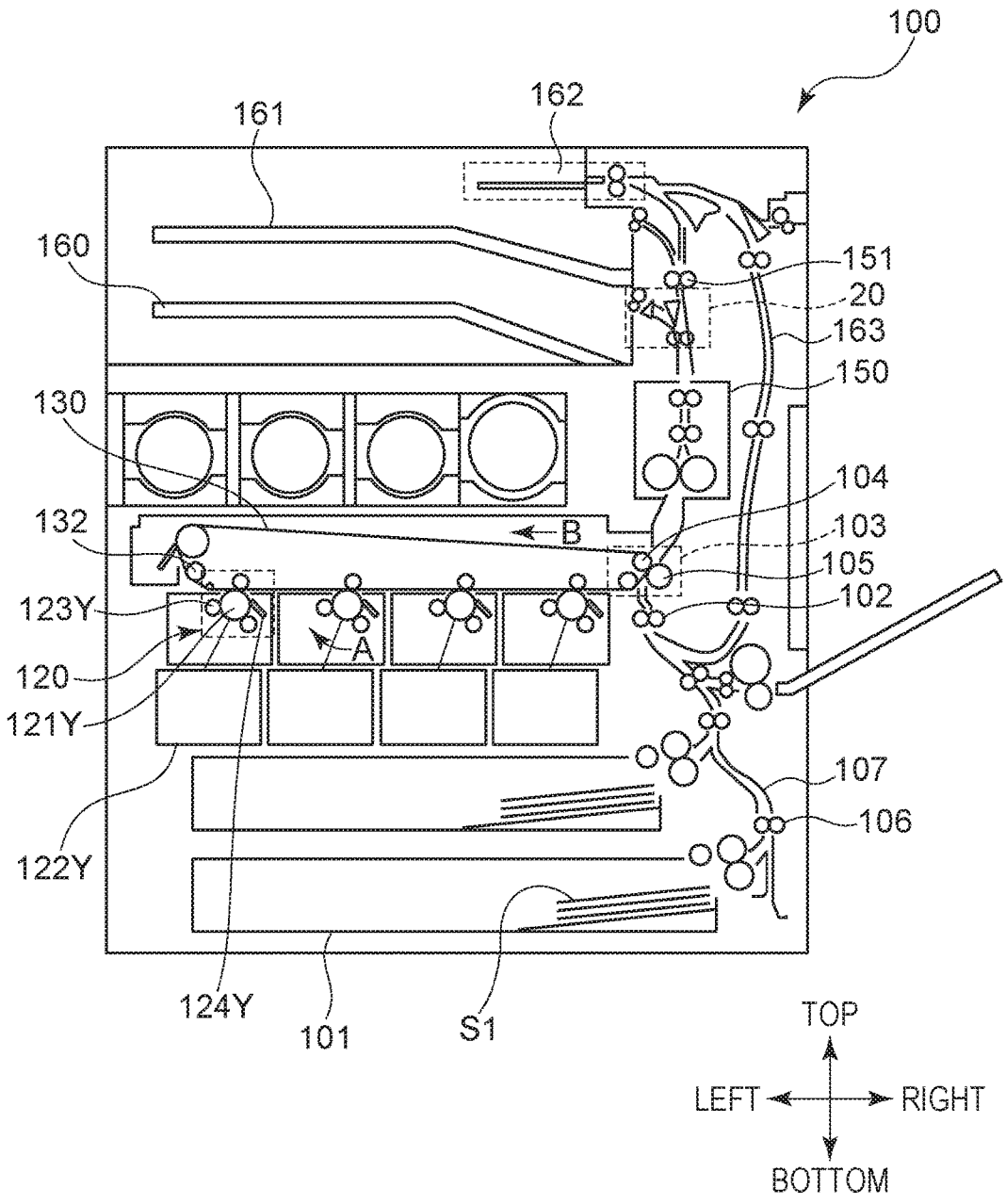
FIG. 1 is a sectional view of an image forming apparatus.

FIG. 1 is a sectional view of an image forming apparatus 100 according to the present embodiment of the invention.

Sheets S1 are accommodated in such a manner as to be stacked on a lift-up tray included in a sheet-feeding container 101, which is a sheet-stacking unit. The sheets S1 accommodated in the sheet-feeding container 101 are to be sent out by a sheet-feeding mechanism. One of the sheets S1, which has been sent out by the sheet-feeding mechanism, is transported along a feeding path 107 by a pair of feeding rollers 106. Skew correction is performed on the sheet S1, which has been transported along the feeding path 107, by a pair of registration rollers 102. The sheet S1, on which the skew correction has been performed by the registration rollers 102, is transported to a second transfer unit 103 by the registration rollers 102.

The second transfer unit 103 is a transfer nip portion formed by an internal second transfer roller 104 and an external second transfer roller 105. The second transfer unit 103 transfers a toner image onto a front surface of one of the sheets S1, which has been transported.

A process of forming a toner image that is transferred onto one of the sheets S1 in the second transfer unit 103 will now be described. An image forming unit 120 includes a photoconductor 121, a charging unit (not illustrated), an exposure mechanism 122, a developing unit 123, a first transfer mechanism, and a photoconductor cleaner 124.

The exposure mechanism 122 radiates a laser beam according to an image signal onto a surface of the photoconductor 121 that rotates in the direction of arrow A in FIG. 1, the surface having been previously and uniformly charged by the charging unit. As a result of the laser beam being radiated onto the surface of the photoconductor 121, an electrostatic latent image is formed on the surface of the photoconductor 121.

The electrostatic latent image formed on the photoconductor 121 is developed with a toner by the developing unit 123. As a result, a toner image is formed on the photoconductor 121. The toner image on the photoconductor 121 is transferred onto an intermediate transfer belt 130 by the first transfer mechanism. After that, a small amount of residual toner that remains on the photoconductor 121 is collected by the photoconductor cleaner 124.

In the case illustrated in FIG. 1, there are four image forming units 120, each of which has been described above and each of which corresponds to one of yellow (Y), magenta (M), cyan (C), and black (Bk). It is obvious that the colors are not limited to these four colors, and the order of the colors is not limited to this order.

The intermediate transfer belt 130 is stretched by rollers such as a driving roller, the internal second transfer roller 104, and a tension roller 132, and is driven so as to move in the direction of arrow B in FIG. 1. Thus, image forming processes for different color images that are to be performed in parallel by the above-described image forming units 120, which correspond to the colors Y, M, C, and Bk, are performed at the timing at which toner images that are positioned upstream and that have been transferred in a first transfer process to the intermediate transfer belt 130 are superposed with one another. As a result, a full-color toner image is ultimately formed on the intermediate transfer belt 130 and is transported to the second transfer unit 103. In the second transfer unit 103, the full-color toner image is transferred onto one of the sheets S1.

After that, the sheet S1, to which the toner image has been transferred, is transported to a fixing member 150, and the toner image is dissolved and fixed onto the sheet S1 by a pressing unit, a heating unit, and the like.

The image forming unit 120, the second transfer unit 103, and the fixing member 150, which have been described above, are included in the image forming unit 120 that forms an image on one of the sheets S1.

One of the sheets S1 to which an image has been fixed in the above manner is transported by a transport device 20, which is a sheet transport device.

Figure 2:
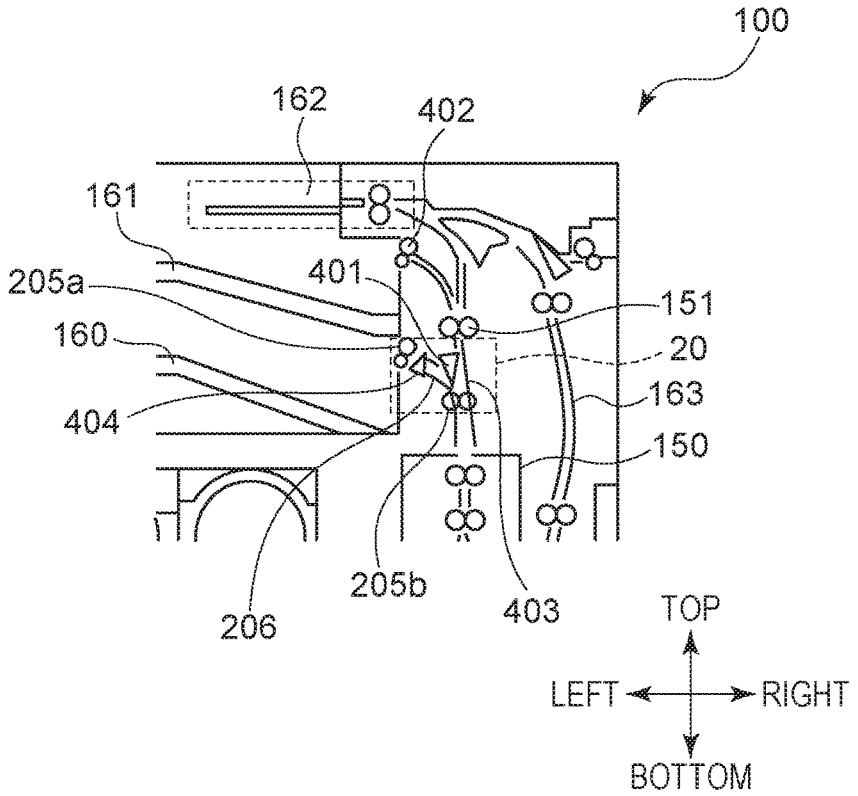
FIG. 2 is an enlarged view of the image forming apparatus.

FIG. 2 is an enlarged view illustrating members including the transport device 20 that are positioned downstream from a fixing unit 150 in a transport direction and that are used in transportation of the sheets S1.

The transport device 20 includes a first transport roller 205*b* and a second transport roller 205*a*. A swing guide 401 is disposed between the first transport roller 205*b* and the second transport roller 205*a*. The swing guide 401 moves selectively to a position where the swing guide 401 guides one of the sheets S1, which is transported by the first transport roller 205*b*, to the second transport roller 205*a* and to a position where the swing guide 401 guides the sheet S1 upward.

The sheet S1 that has been transported to the second transport roller 205*a* by the swing guide 401 is ejected to a first ejection tray 160 by the second transport roller 205*a*, which serves as a rotating member.

The transport device 20 includes a guide 206 that guides a first surface of one of the sheets S1 and an opposing guide 403 that guides a second surface of the sheet S1. A sensing unit 404 that detects one of the sheets S1 is disposed between the first transport roller 205*b* and the second transport roller 205*a*.

One of the sheets S1 that has been guided upward by the swing guide 401 is transported upward by a pair of relay rollers 151. The sheet S1 that is transported upward by the relay rollers 151 is ejected to a second ejection tray 161 by a pair of ejection rollers 402.

In the case of forming images on the two surfaces of one of the sheets S1, the sheet S1 is transported in the following manner. That is to say, the sheet S1 that has been transported upward by the relay rollers 151 is transported to a reverse-transport mechanism 162. The sheet S1 that has been transported to the reverse-transport mechanism 162 is switched back by the reverse-transport mechanism 162 and transported to a two-sided printing transport path 163. The sheet S1 is guided to the registration rollers 102 by the two-sided printing transport path 163. A toner image is transferred onto the rear surface of the sheet S1, which has been guided to the registration rollers 102, by the second transfer unit 103.

The configuration of the transport device 20 will now be described in detail.

Figure 3:
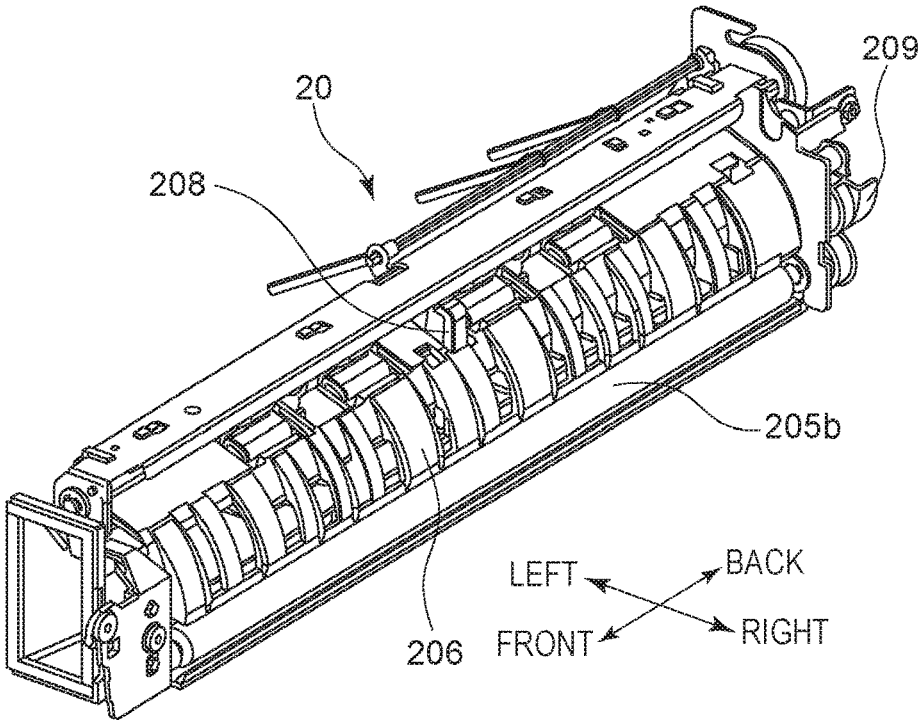
FIG. 3 is a perspective view of a principal portion of the image forming apparatus as seen from a forward direction.
Figure 4:
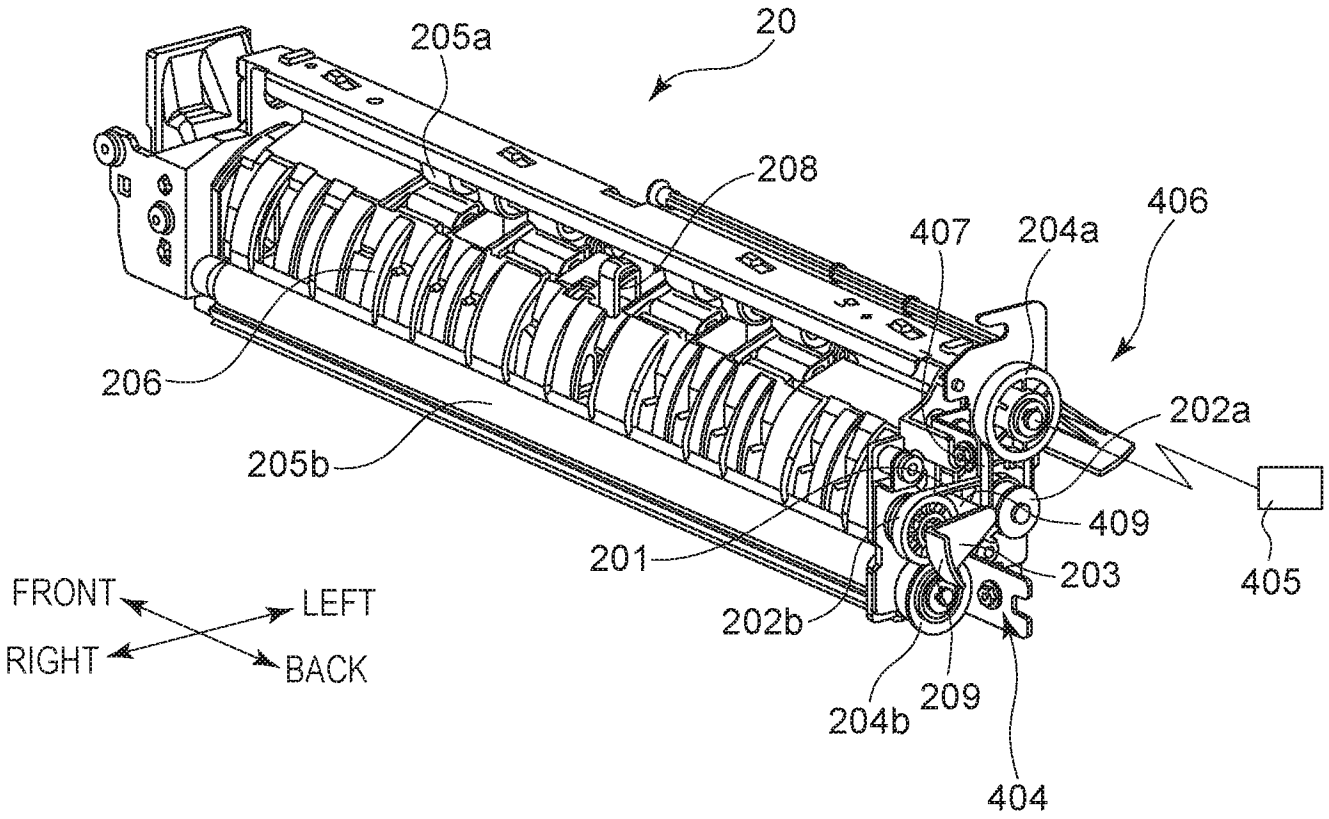
FIG. 4 is a perspective view of the principal portion of the image forming apparatus as seen from a right-backward direction.
Figure 5:
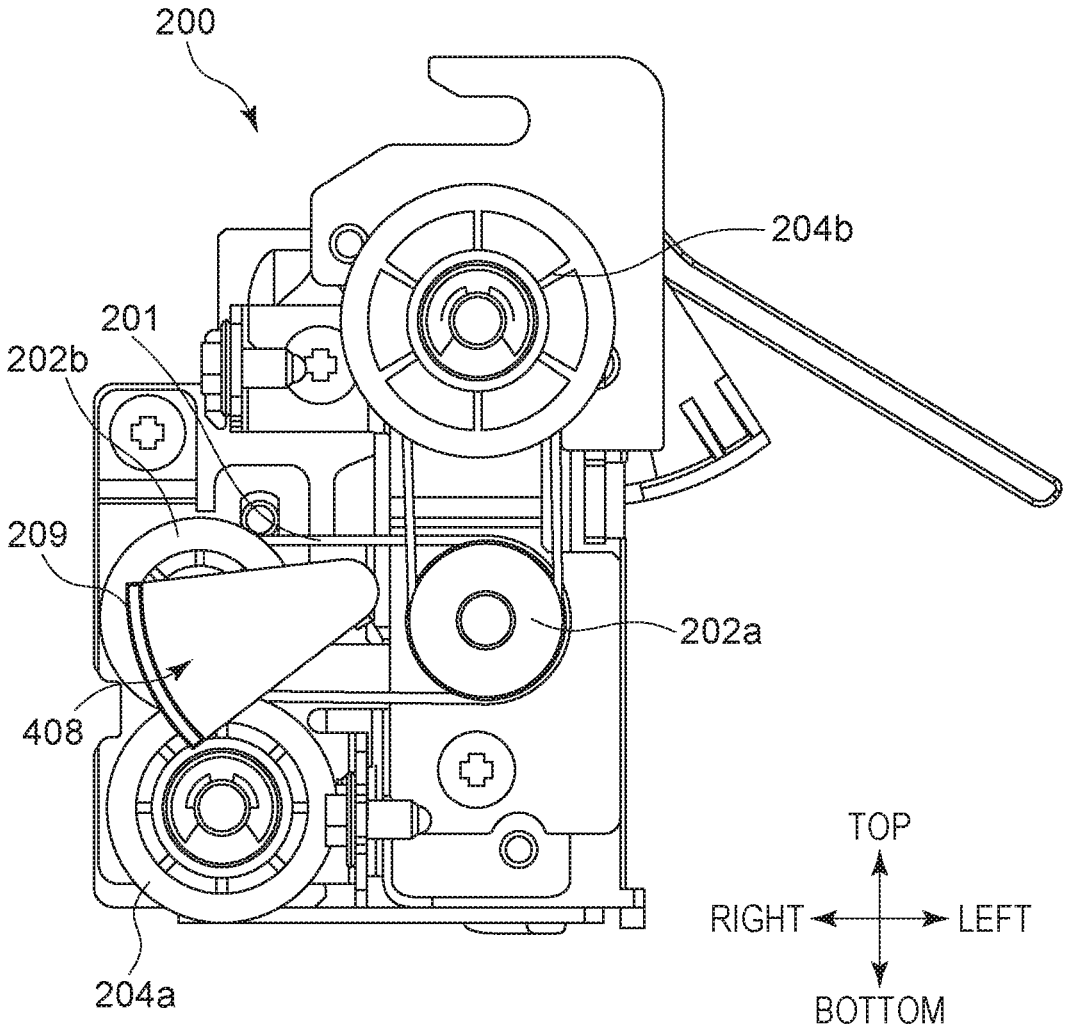
FIG. 5 is a detailed view of the principal portion of the image forming apparatus as seen from a backward direction.

FIG. 3 is a detailed perspective view of the transport device 20 as seen from a right-forward direction, and FIG. 4 is a perspective view of the transport device 20 as seen from the right-backward direction. FIG. 5 is a diagram illustrating the transport device 20 as seen from the backward direction.

As illustrated in FIG. 4, a drive transmission unit 406 that transmits a driving force from a motor 405 to the first and second transport rollers 205*b* and 205*a* is disposed on the back side of the image forming apparatus 100.

The drive transmission unit 406 includes a drive-input unit 204*a* to which the driving force from the motor 405 is to be transmitted and a first pulley 202*a*. The drive-input unit 204*a* is attached to an end portion of a shaft of the second transport roller 205*a* and integrally rotates with the second transport roller 205*a*.

A first timing belt 407 is stretched between the drive-input unit 204*a* and the first pulley 202*a*. A driving force is transmitted from the drive-input unit 204*a* to the first pulley 202*a* via the first timing belt 407.

The drive transmission unit 406 includes a second pulley 202*b*. The drive transmission unit 406 further includes a second timing belt 201 that is stretched between the first pulley 202*a* and the second pulley 202*b*. A driving force is transmitted from the first pulley 202*a* to the second pulley 202*b* via the second timing belt 201.

The second pulley 202*b* includes a gear tooth that engages with a gear 204*b*. The driving force that has been transmitted to the second pulley 202*b* via the second timing belt 201 is transmitted to the gear 204*b*.

The gear 204*b* is attached to an end portion of a shaft of the first transport roller 205*b* and rotates integrally with the first transport roller 205*b*, which serves as a transport unit. In other words, the first transport roller 205*b*, which serves as the rotating member, is caused to rotate by a rotational driving force from the motor 405 that has been transmitted to the gear 204*b* by the drive transmission unit 406.

Figure 6:
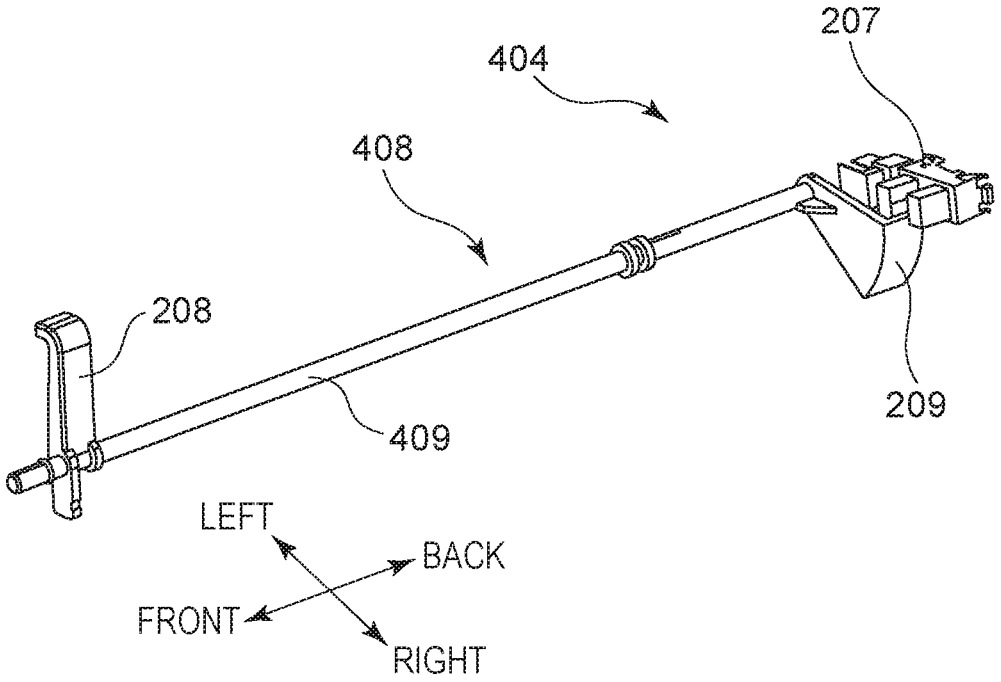
FIG. 6 is a diagram illustrating the configuration of a sensor flag and the configuration of a photosensor.

As illustrated in FIG. 6, the sensing unit 404, which detects one of the sheets S1 between the first transport roller 205*b* and the second transport roller 205*a*, includes a rotary member 408 and a photo-interrupter 207, which serves as a sensor that generates a signal corresponding to rotation of the rotary member 408.

The rotary member 408 includes a contact portion 208 that is brought into contact with one of the sheets S1, which is transported, a light-blocking portion 209 that blocks an optical path of the photo-interrupter 207, and a columnar shaft portion 409 that extends in an axial direction in such a manner as to connect the contact portion 208 and the light-blocking portion 209. The rotary member 408 is supported by a main body of the transport device 20 in such a manner as to be capable of rotating about the shaft portion 409.

One of the sheets S1 that is transported by the first transport roller 205*b* while being guided by the guide 206 illustrated in FIGS. 3 and 4 is brought into contact with the contact portion 208. The sheet S1 that has been brought into contact with the contact portion 208 causes the rotary member 408 to rotate. When the rotary member 408 rotates, the light-blocking portion 209 of the rotary member 408 switches between a light blocking state and a non-light blocking state of the photo-interrupter 207 (see FIG. 6). The light blocking state of the photo-interrupter 207 is a state where the light-blocking portion 209 is blocking the optical path of the photo-interrupter 207. The non-light blocking state of the photo-interrupter 207 is a state where the light-blocking portion 209 is not blocking the optical path of the photo-interrupter 207.

The photo-interrupter 207 generates signals each of which corresponds to the light blocking state or the non-light blocking state of the photo-interrupter 207. In other words, the photo-interrupter 207 generates signals in accordance with rotation of the rotary member 408. A control unit (not illustrated) that receives the signals from the photo-interrupter 207 recognizes the presence or absence of one of the sheets S1 on the guide 206 on the basis of the signals from the photo-interrupter 207.

As illustrated in FIG. 6, the contact portion 208 projects from the shaft portion 409 in a radial direction. In addition, as illustrated in FIGS. 3 and 4, the contact portion 208 projects from the guide 206 into a transport path, which is formed of the guide 206. The shaft portion 409 extends in a front-backward direction of the transport device 20, that is, in a width direction of one of the sheets S1, the width direction being perpendicular to the transport direction in which the sheet S1 is to be transported. As illustrated in FIG. 6, the contact portion 208 and the light-blocking portion 209 are respectively attached to the end portions of the shaft portion 409 of the rotary member 408.

As illustrated in FIG. 4 and FIG. 5, the shaft portion 409 of the rotary member 408 is positioned in such a manner as to face an inner peripheral portion of the second timing belt 201, which is ring-shaped. In other words, the shaft portion 409 of the rotary member 408 is disposed inside a ring formed of the ring-shaped second timing belt 201. In the axial direction in which the shaft portion 409 of the rotary member 408 extends, the contact portion 208 and the light-blocking portion 209 are arranged in such a manner that the second timing belt 201 is interposed between the contact portion 208 and the light-blocking portion 209. Note that the axial direction of the rotary member 408 is parallel to the axial direction of the second pulley 202*b*.

In the axial direction of the rotary member 408, the contact portion 208 is positioned between the second timing belt 201 and the guide 206 (a transport region in which one of the sheets S1 is to be transported). In the axial direction of the rotary member 408, the light-blocking portion 209 is positioned on the side opposite to the side on which the guide 206 is disposed with the second timing belt 201 interposed between the light-blocking portion 209 and the guide 206. In the axial direction of the rotary member 408, the photo-interrupter 207 is positioned on the side opposite to the side on which the guide 206 is disposed with the second timing belt 201 interposed between the photo-interrupter 207 and the guide 206. In addition, in the axial direction of the rotary member 408, the motor 405 is positioned on the side opposite to the side on which the guide 206 is disposed with the second timing belt 201 interposed between the motor 405 and the guide 206.

The shaft portion 409 of the rotary member 408 is located at a position facing an inner peripheral surface of the ring-shaped second timing belt 201. The transport device 20 can be reduced in size by employing the above-described configuration. If the rotary member 408 is arranged so as not to face the inner peripheral surface of the ring-shaped second timing belt 201, the size of the transport device 20 will increase. In other words, when trying to arrange the rotary member 408 so as not to face the inner peripheral surface of the ring-shaped second timing belt 201, the second timing belt 201 needs to be arranged in a space different from that in the present embodiment in such a manner as to stay away from the shaft portion 409 of the rotary member 408. In this case, it is necessary to ensure a space in which the second timing belt 201 is arranged, and consequently, the size of the transport device 20 increases. In order to arrange the second timing belt 201 in a position away from the shaft portion 409 of the rotary member 408, the first pulley 202*a* and the second pulley 202*b*, which support the second timing belt 201, need to be arranged in a space different from that in the present embodiment. In this case, it is necessary to ensure a space in which the first pulley 202*a* and the second pulley 202*b* are arranged, and consequently, the size of the transport device 20 increases.

The motor 405 and the photo-interrupter 207 are disposed so as to oppose the guide 206 across the second timing belt 201 and arranged so as to be close to each other. Thus, electric flux lines from the motor 405 and the photo-interrupter 207 can be short. Since the electric flux lines can be short, the manufacturing costs can be reduced.

Figure 7:
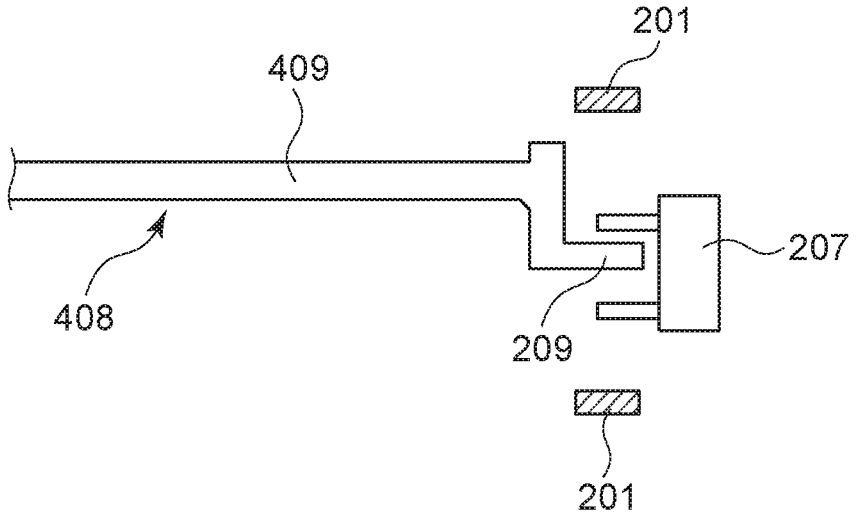
FIG. 7 is a diagram illustrating a modification.

Note that, the embodiment in which the shaft portion 409 of the rotary member 408 is positioned in such a manner as to face the inner peripheral portion of the second timing belt 201 has been described above as an example. However, the rotary member 408 may be positioned in such a manner that a portion of the rotary member 408 faces the inner peripheral portion of the second timing belt 201. For example, as in a modification illustrated in a longitudinal sectional view in FIG. 7, the light-blocking portion 209 of the rotary member 408 may face the inner peripheral portion of the second timing belt 201.

As described above, the drive transmission unit 406 that transmits the driving force from the motor 405 to the first transport roller 205*b* is provided in the present embodiment. The shaft portion 409 of the rotary member 408 is positioned in an inner space enclosed by the endless second timing belt 201 of the drive transmission unit 406. Accordingly, the rotary member 408 can be efficiently and compactly arranged in the transport device 20, and thus, a reduction in the size of the transport device 20 can be achieved.

In the above description, as the image forming unit 120, an image forming unit that employs an electrophotographic system has been described as an example. However, the image forming apparatus 100 may include an image forming unit that employs an ink-jet method.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-140583, filed Jul. 14, 2015, which is hereby incorporated by reference herein in its entirety.

What is claimed is:

1. A sheet transport device comprising:

a transport rotary unit that transports a sheet in a transporting direction by rotating;

a rotary member that rotates by being pressed by the sheet transported by the transport rotary unit;

a photo-interrupter that generates a signal in accordance with rotation of the rotary member; and an endless belt that transmits a driving force from a motor to the transport rotary unit, wherein the rotary member includes a shaft extending in an axial direction of the rotary member, a contact portion that projects from the shaft and that is brought into contact with the sheet transported, and a light-blocking portion that blocks an optical path of the photo-interrupter, wherein the contact portion and the light-blocking portion are arranged in such a manner that the endless belt is interposed between the contact portion and the light-blocking portion in the axial direction of the rotary member, and wherein the rotary member is arranged in such a manner that part of the shaft of the rotary member is surrounded by the endless belt.

2. The sheet transport device according to claim 1, wherein both the photo-interrupter and the motor are arranged in such a manner as to oppose a transport region in which the sheet is transported with respect to the endless belt in the width direction of sheet.

3. The sheet transport device according to claim 1,
wherein the photo-interrupter is arranged outside of the transporting region in the width direction of sheet.

4. The sheet transport device according to claim 1,
wherein the endless-belt is arranged outside of a transport region in the axial direction, and the transport rotary unit transports the sheet in the transport region.

5. The sheet transport device according to claim 1,
wherein the endless-belt is not contacted to the sheet transported by the transport rotary unit.

6. A sheet transport device comprising:
a transporting roller that includes
a roller shaft, and
a receiving portion configured to receive a rotating force from a motor and provided at an end portion of the roller shaft in an axial direction of the transporting roller,
wherein the transporting roller transports a sheet in a transporting direction perpendicular to the axial direction by the rotating force received by the receiving portion;
a transmission unit that transmits the rotating force from the motor to the receiving portion;
a rotary member that rotates by being pressed by the sheet transported; and
a photo-interrupter that generates a signal,
wherein the rotary member includes
a contact portion that is brought into contact with the sheet transported,
a light-blocking portion that blocks an optical path of the photo-interrupter, and
a shaft that connects the contact portion and the light-blocking portion,
wherein the transmission unit includes
a pulley, and
a ring-shaped belt supported by the pulley,
wherein the contact portion and the light-blocking portion are arranged in such a manner that the ring-shaped belt is interposed between the contact portion and the light-blocking portion in the axial direction,
wherein the ring-shaped belt is arranged outside of a transport region in the axial direction, and the transporting roller transports the sheet in the transport region, and
wherein the shaft of the rotary member is disposed inside a ring formed of the ring-shaped belt.

7. The sheet transport device according to claim 6,
wherein the shaft of the rotary member is disposed inside the ring formed of the ring-shaped belt.

8. The sheet transport device according to claim 6,
wherein both the photo-interrupter and the motor are arranged in such a manner as to oppose the transport across the ring-shaped belt in the axial direction.

9. The sheet transport device according to claim 6,
wherein the photo-interrupter is arranged outside of the transporting region in the axial direction.

10. An image forming apparatus comprising:
a transport rotary unit that transports a sheet in a transporting direction by rotating;
an image forming unit that forms an image on the sheet, which is transported by the transport rotary unit;
a rotary member that rotates by being pressed by the sheet, which is transported by the transport unit;
a photo-interrupter that generates a signal in accordance with rotation of the rotary member; and
an endless belt that transmits a driving force from a motor to the transport rotary unit,
wherein the rotary member includes
a shaft extending in an axial direction of the rotary member,
a contact portion that projects from the shaft and that is brought into contact with the sheet transported, and
a light-blocking portion that blocks an optical path of the photo-interrupter,
wherein the contact portion and the light-blocking portion are arranged in such a manner that the endless belt is interposed between the contact portion and the light-blocking portion in the axial direction of the rotary member, and
wherein the rotary member is arranged in such a manner that part of the shaft of the rotary member is surrounded by the endless belt.

11. A sheet transport device comprising:
a transport rotary unit that transports a sheet in a transporting direction by rotating;
a rotary member that rotates by being pressed by the sheet transported by the transport rotary unit;
a photo-interrupter that generates a signal in accordance with rotation of the rotary member; and
a ring-shaped belt that transmits a driving force from a motor to the transport rotary unit,
wherein the rotary member includes
a shaft extending in an axial direction of the rotary member,
a contact portion that projects from the shaft and that is brought into contact with the sheet transported, and
a light-blocking portion that blocks an optical path of the photointerrupter,
wherein the contact portion and the light-blocking portion are arranged in such a manner that the ring-shaped belt is interposed between the contact portion and the light-blocking portion in the axial direction of the rotary member, and
wherein the shaft of the rotary member is disposed inside a ring formed of the ring-shaped belt.

12. The sheet transport device according to claim 11,
wherein the ring-shaped belt is arranged outside of a transport region in which the transport rotary unit transports the sheet.

* * * * *